US006979080B2

(12) United States Patent
Samoto et al.

(10) Patent No.: US 6,979,080 B2
(45) Date of Patent: Dec. 27, 2005

(54) PRINTER HAVING IMPROVED RECORDING MEDIUM FEEDING MECHANISM

(75) Inventors: Kenji Samoto, Aichi-ken (JP); Masaru Takeuchi, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/230,157

(22) Filed: Aug. 29, 2002

(65) Prior Publication Data

US 2003/0043248 A1 Mar. 6, 2003

(30) Foreign Application Priority Data

Aug. 29, 2001 (JP) ..... 2001-259487
Aug. 29, 2001 (JP) ..... 2001-259488
Mar. 29, 2002 (JP) ..... 2002-097491

(51) Int. Cl.[7] ..... B41J 2/01
(52) U.S. Cl. ..... 347/104; 400/578
(58) Field of Search ..... 347/104, 101, 347/102; 400/578, 582

(56) References Cited

U.S. PATENT DOCUMENTS 5,291,227 A * 3/1994 Suzuki ..... 347/104
5,297,871 A * 3/1994 Fujioka ..... 400/568
5,480,132 A * 1/1996 Kiyohara et al. ..... 271/10.01
5,488,467 A * 1/1996 Marentes et al. ..... 399/68
5,524,994 A * 6/1996 Hirano et al. ..... 400/579
5,530,466 A * 6/1996 Fujioka et al. ..... 347/104
5,594,486 A * 1/1997 Kiyohara ..... 347/104
5,718,523 A * 2/1998 Shiina et al. ..... 400/120.04
5,847,719 A * 12/1998 Yamaguchi et al. ..... 346/134
5,874,979 A * 2/1999 Ohyama ..... 347/104
6,092,892 A * 7/2000 Taniguro et al. ..... 347/104
6,457,888 B1 * 10/2002 Matsumoto ..... 400/625
6,503,011 B2 * 1/2003 Kono ..... 400/646

FOREIGN PATENT DOCUMENTS

| | | |
|---|---|---|
| JP | A 5-341589 | 12/1993 |
| JP | A 7-285251 | 10/1995 |
| JP | A 08-224864 | 9/1996 |
| JP | A 10-129056 | 5/1998 |
| JP | A 10-181128 | 7/1998 |
| JP | A 11-245457 | 9/1999 |
| JP | B2 3019883 | 1/2000 |
| JP | A 2000-211762 | 8/2000 |

* cited by examiner

*Primary Examiner*—Manish Shah
*Assistant Examiner*—Leonard Liang
(74) *Attorney, Agent, or Firm*—Oliff & Berridge, PLC

(57) ABSTRACT

A printer includes a print head including nozzles that eject ink on a recording medium sheet, first and second rollers provided on a sheet feeding path for feeding the sheet therealong, a platen provided between the first and second rollers for guiding the sheet on the sheet feeding path, and a guide roller disposed between the nozzles and the second roller on the feeding path. A rotation axis of the guide roller is fixed with respect to the feeding path. The guide roller disposed as above restricts the movement of the sheet in a direction away from the platen and thereby prevents the sheet from floating on the platen.

23 Claims, 16 Drawing Sheets

PRINTER HAVING IMPROVED RECORDING MEDIUM FEEDING MECHANISM

BACKGROUND OF THE INVENTION

The present invention relates to a printer, such as an inkjet printer, having an improved recording medium feeding mechanism.

An inkjet printer records images on a recording medium sheet, that is fed along a sheet feeding path, with a print head which moves across the sheet in a direction perpendicular to the sheet feeding path.

An inkjet printer usually includes a feed roller and a discharge roller for feeding the sheet along the sheet feeding path, and the print head is located between the two rollers. A platen is opposingly arranged below the print head at a distance from the print head appropriate for inkjet printing. A plurality of pinch rollers are opposingly arranged above the discharge roller to guide the sheet therebetween.

In such an inkjet printer, when the leading end of the sheet is fed beyond the discharge roller, it tends to rotate along the circumferential periphery of the discharge roller. As a result, the trailing end of the sheet tends to float on the platen which causes deterioration of printing quality.

The rotation of the discharge roller is usually adjusted such that the peripheral velocity thereof becomes slightly higher than that of the feed roller. The difference in the peripheral velocities of the two rollers applies tension to the sheet therebetween and keeps the sheet from slacking and/or floating on the platen. The feeding velocity of the sheet, however, changes when the trailing end of the sheet has passed the feed roller and the sheet becomes to be fed only by the discharge roller. Such change of feeding velocity is not desirable since this also causes deterioration of the printing quality.

Usually, the feed roller and the discharge roller are held by supporting members located beside the sheet feeding path, and are rotatably driven by a single driving mechanism that is mounted to one of the supporting members. The supporting member supporting the driving mechanism is located apart from the space, within which the print head moves during printing, in order to avoid interference between the driving mechanism and the print head. Accordingly, the distance between the supporting members, and therefore the length of the discharge roller held by the supporting members, are relatively long.

Since longer rollers generally require higher strength against bending and twisting, the shaft of the long discharge roller is made of metal to obtain the required strength. However, the use of a metal shaft is one of the causes that make cost reduction of the printer difficult.

SUMMARY OF THE INVENTION

It is therefore an object of the invention to provide a printer capable of preventing a recording medium from floating on the platen.

It is another object of the invention to provide a printer capable of preventing the feeding velocity of a recording medium from varying during printing.

It is a further object of the invention to provide a printer capable of unnecessitating a discharge roller to have high strength against bending and twisting.

According to an aspect of the invention, there is provided a printer including a print head having nozzles that eject ink on a recording medium sheet, first and second rollers provided on a sheet feeding path for feeding the sheet therealong, a platen provided between the first and second rollers for guiding the sheet on the sheet feeding path, and a guide roller disposed between the nozzles and the second roller on the feeding path with its rotation axis being fixed with respect to the feeding path. The guide roller disposed as above restricts the movement of the sheet in a direction away from the platen and thereby prevents the sheet from floating on the platen.

Optionally, the guide roller is disposed such that the guide roller contacts the sheet below a top surface of the platen. If the guide roller is disposed as above, the sheet is bent by the guide roller such that the portion of the sheet still remaining on the platen is slightly pulled toward the platen. Thus, the sheet is kept from floating on the platen.

Further optionally, the printer includes a pinch roller elastically biased towards the second roller to press the sheet against the second roller. The pinch is disposed such that a nip point where the pinch roller and the second roller contact the sheet is located below the top surface of the platen. Preferably, the nip point and a contact point where the guide roller contacts the sheet are located on a plane parallel to the top surface of the platen.

Optionally, the first roller and the guide roller contact the sheet at the side opposite to the side sustained by the platen so that the sheet is pressed against the platen by both the first roller and the guide roller.

Optionally, the printer has a plurality of pinch rollers that are elastically biased towards the second roller to press the sheet against the second roller and a plurality of the guide rollers. The pinch rollers and the guide rollers are alternately disposed in a sheet width direction.

Further optionally, the pinch rollers and the guide rollers are located such that nip points where the pinch rollers and the second roller nip the sheet and contact points where the guide rollers contact the sheet are located below the top surface of the platen.

In some cases, the printer further includes an intermediate roller provided between the nozzles and the second roller. The intermediate roller is elastically biased towards the guide roller to press the sheet against the guide roller. The intermediate roller is rotated with a peripheral velocity higher than that of the first roller. Thus, when the sheet reaches the intermediate roller, the intermediate roller pulls the leading end of the sheet and introduces it smoothly between the intermediate roller and the guide roller.

The intermediate roller is formed such that a slip occurs between the intermediate roller and the sheet while the sheet is being fed by the first roller. The slip of the intermediate roller prevents the sheet from being fed faster than the feeding velocity of the feed roller. Thus, the feeding velocity of the sheet is kept same before and after the sheet is caught between the intermediate roller and the guide roller.

The intermediate roller that slips against the sheet can be formed by a material having a low coefficient of friction against the sheet compared to that of the first roller. For example, the outer circumference of the intermediate roller may be formed by hard resin.

In addition to the above, the intermediate roller can be formed to slip against the sheet by forming a plurality of larger diameter portions that are spaced apart from each other along the longitudinal axis of the intermediate roller. Such larger diameter portions restricts the area of the intermediate roller that comes in contact with the sheet and thereby reduces the friction between the intermediate roller and the sheet which in turn allows the intermediate roller to slip against the sheet.

It should be noted that although the second roller in conventional printers are generally rotated with a peripheral velocity higher than that of the first roller to apply tension to the sheet for preventing the sheet from slacking on the platen, the second roller of the printer provided with the intermediate roller mentioned above may be rotated with a peripheral velocity same as that of the feed roller since the intermediate roller applies the necessary tension to the sheet.

It should be further noted that the second roller rotated with the peripheral velocity same as that of the first roller does not change the feeding velocity of the sheet even if the sheet has passed the first roller and becomes to be fed only by the second roller. Thus, the feed velocity of the sheet becomes constant over the entire printing process.

In some cases, the printer further includes a driving unit for rotatably driving the second roller. To prevent the interference between the driving unit and the print head during printing, the driving unit is located outside a printing area of the print head.

The driving unit includes an extension shaft extending toward the second roller. The driving unit is connected with the second roller by this extension shaft to transmit the driving force for rotating the second roller.

By the printer configured as above, the second roller is made in relatively short size although the driving unit is placed apart from the printing area. Accordingly, the shaft of the second roller is not required to be made of materials such as metal that have high strength against bending or twisting, but can be made of low-cost resin.

Optionally, the driving unit includes a motor and a plurality of gears for transmitting the driving force from the motor. In such case, the extension shaft may be a protrusion formed to one of the gears along a rotation axis thereof.

Optionally, the extension shaft is connected with the second roller by means of a free joint mechanism. If the extension shaft is directly connected with the second roller, the driving unit has to be precisely located such that the rotation axis of the extension shaft coincides with the rotation axis of the second roller. This requires each part of the driving unit and a mechanism holding the driving unit to be made in accurate size and form which may be very costly. The free joint mechanism, however, allows the extension shaft to be inclined against the second roller, and does not require the driving unit to be located precisely at a particular location. Thus, the utilization of the free joint mechanism allows the printer to be produced in low cost.

In addition to the free joint mechanism, the printer may have a holding mechanism that holds the second roller such that the posture of the second roller can be adjusted against the print head.

Alternatively, the printer may have a main frame and a supporting member for supporting the platen. The platen rotatably holds the second roller, and the supporting member is mounted on the main frame in such a fashion that the inclination of the supporting member with respect to the main frame is adjustable.

Further, the second roller may be rotatably fixed to one end of the platen such that the platen is kept parallel to the second roller even if the second roller is moved by said holding mechanism.

BRIEF DESCRIPTION OF THE ACCOMPANYING DRAWINGS

FIG. 1 schematically shows a cross sectional view of an inkjet recording device according to a fist embodiment of the invention;

DETAILED DESCRIPTION OF THE EMBODIMENTS

Hereinafter, embodiments of the invention will be described with reference to the accompanying drawings.

(First Embodiment)

Figure 1:
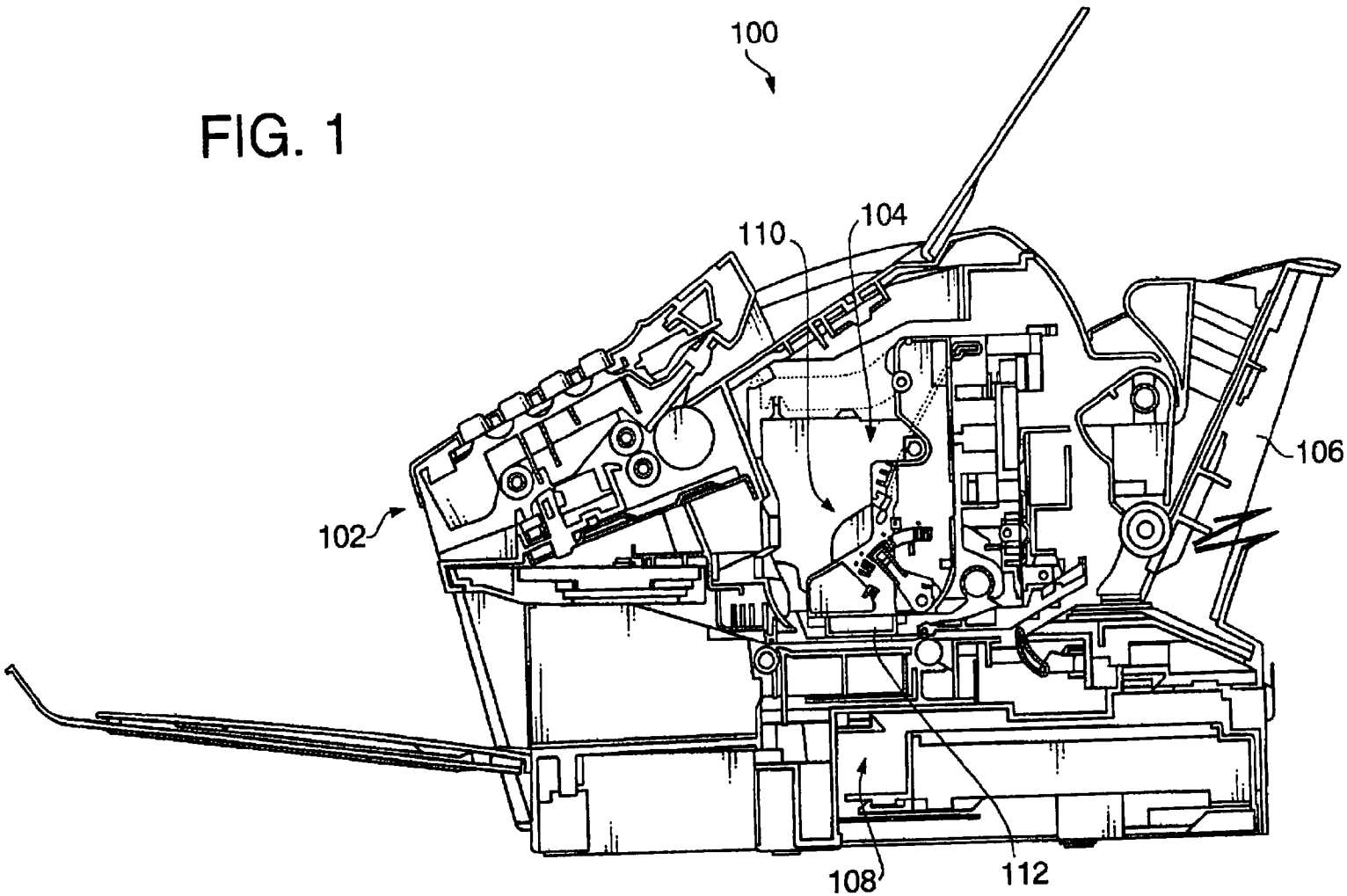

FIG. 1 schematically shows a cross sectional view of an inkjet recording device 100 according to a fist embodiment of the invention. The inkjet recording device 100 is provided with a scanning section 102 for scanning and reading image data of a document passed therethorugh and a communication means (not shown) for sending the image data obtained by the scanning section 102 and/or receiving other image data via a telephone line (not shown). The inkjet recording device 100 is also provided with an inkjet printing section 104 for printing images obtained by the scanning section 102 or the communication means.

The inkjet printing section 104 includes a sheet supply tray 106 in which sheets, or recording mediums, to be printed are stacked, a feeding mechanism 108 for feeding the sheet supplied from the sheet supply tray 106 along a predetermined sheet feeding path, and a print head carriage mechanism 110 holding a print head unit 112 in the vicinity of the sheet feeding path.

Figure 2:
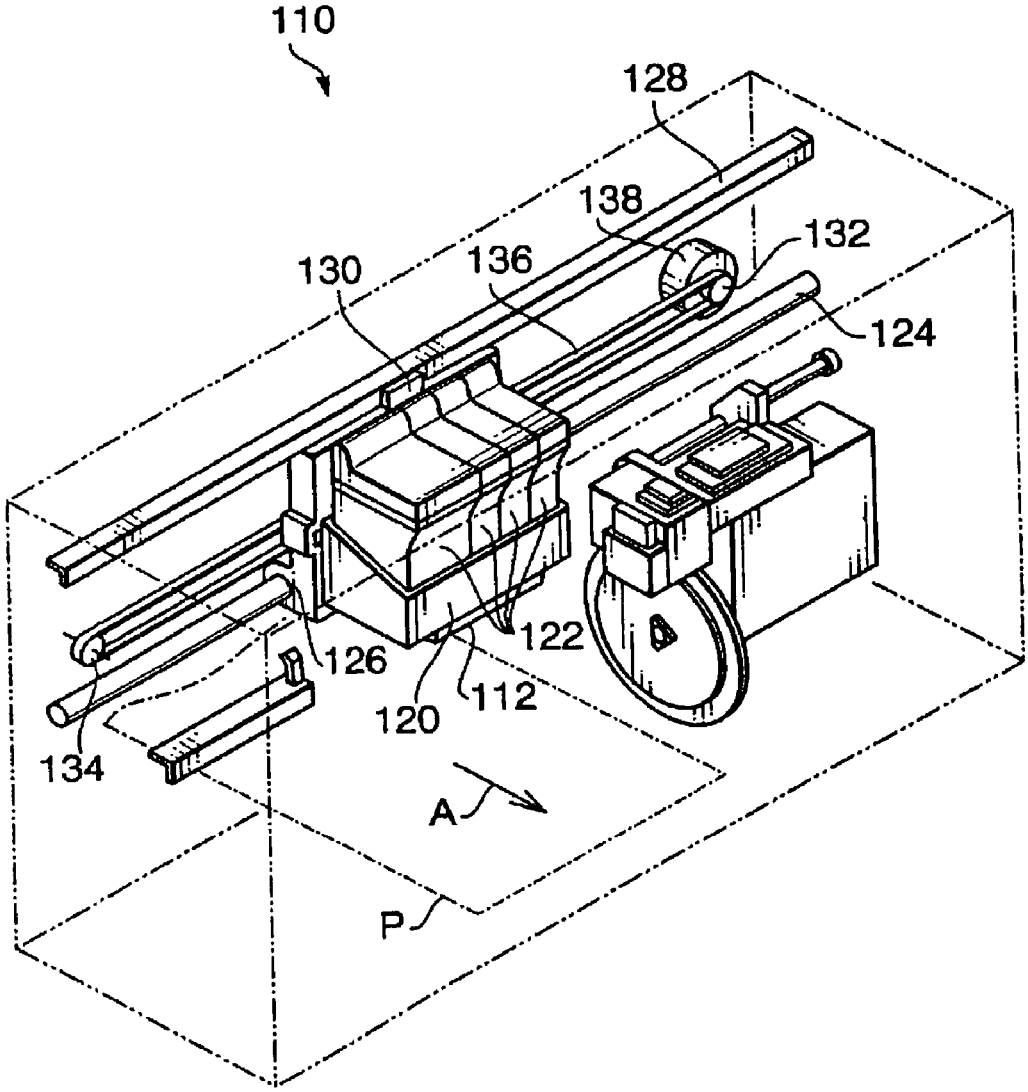
FIG. 2 shows a schematic perspective view of a print head carriage mechanism of the inkjet recording device shown in FIG. 1.

FIG. 2 shows a schematic perspective view of the print head carriage mechanism 110 of the inkjet recording device 100 shown in FIG. 1. Note that the dotted line P in FIG. 2 indicates the sheet fed along the sheet feeding path in a sheet feeding direction indicated by arrow A.

The print head carriage mechanism 110 includes a carriage 120 for supporting ink cartridges 122 and the print head unit 112. In this embodiment, the carriage 120 supports for four ink cartridges 122 containing yellow, magenta, cyan and black inks, respectively. The print head unit 112 includes four inkjet print heads, each connected to one of the four ink cartridges 120 and supplied by the ink contained therein.

A carriage shaft 124 is provided at a lower portion of the carriage 120 perpendicular to the sheet feeding direction A. The carriage shaft 124 is inserted though two engaging holes 126 (only one is shown in FIG. 2) formed near the bottom of the carriage 120 so that the carriage 120 is slidably mounted to the carriage shaft 124.

A guiding plate 128 is provided at an upper portion of the carriage 120 in parallel with the carriage shaft 124. The guiding plate 128 is disposed such that it comes in contact with a contact portion 130 formed at the top of the carriage 120 and thereby guides the carriage 120.

Two pulleys 132, 134 are disposed between the carriage shaft 124 and the guide plate 128, near each end of the carriage shaft 124. An endless belt 136 looped over the pulleys 132, 134 is connected to a rear side of the carriage 120.

A motor 138 is connected to the pulley 132. As the pulley 132 is rotated by the motor 138 in a forward and reverse direction, the carriage 120 is moved by the endless belt 136 and reciprocates linearly along the carriage shaft 124 and thus across the sheet P fed along the sheet feeding path. The print heads eject ink towards the sheet P as the print head unit moves across the sheet P by the carriage mechanism 110 and thereby print an image on the sheet.

Figure 3:
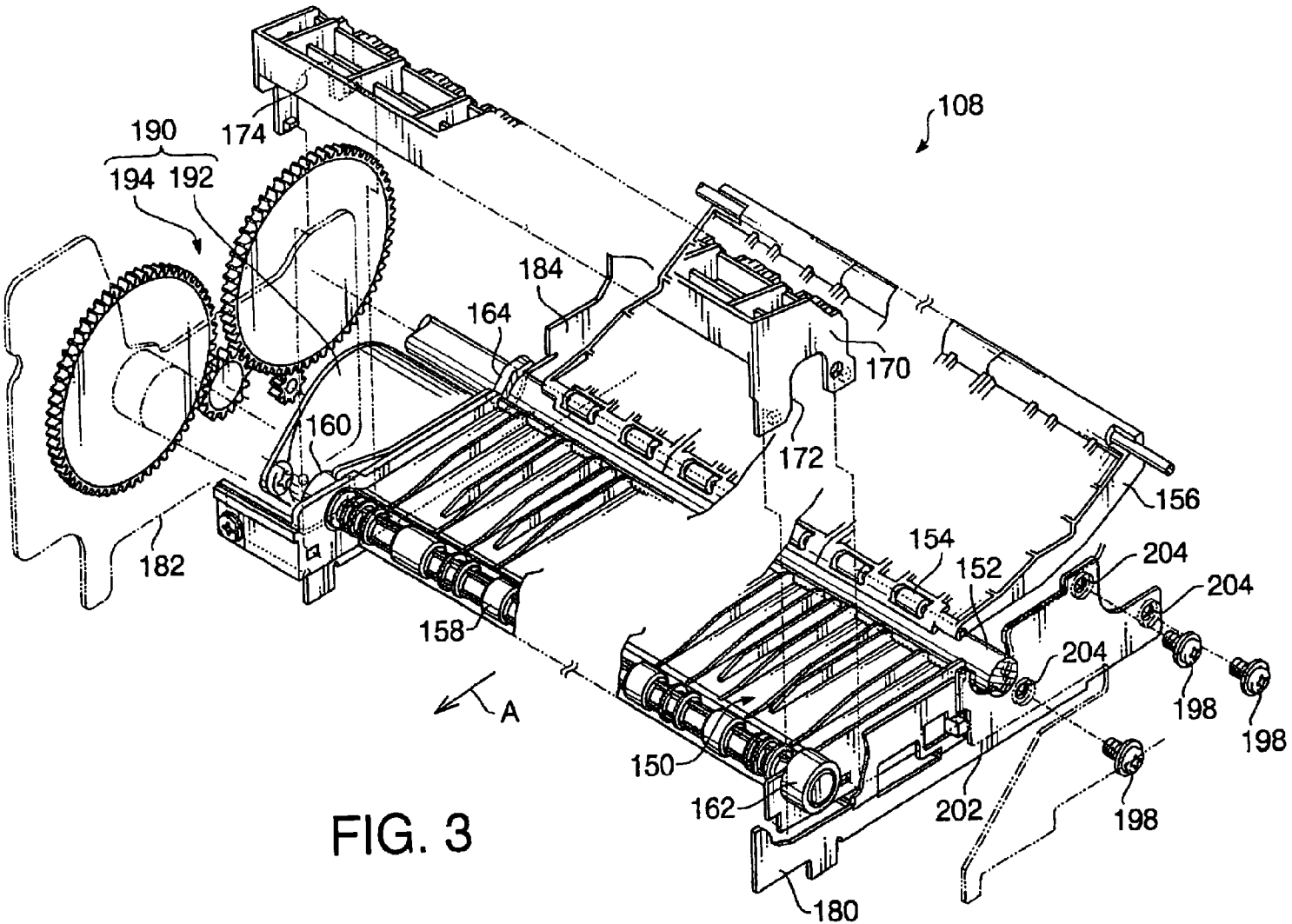
FIG. 3 is a perspective view of a feeding mechanism of the inkjet recording device of FIG. 1.

FIG. 3 is a perspective view of the feeding mechanism 108 of the inkjet recording device 100 of FIG. 1.

The feeding mechanism 108 includes a platen 150 disposed opposite to the print head unit 112 (not shown in FIG. 3) for supporting the sheet P in parallel with the print head unit 112 at a predetermined distance apart therefrom.

A feed roller 152 is disposed to the upstream from the platen 150 with respect to the feeding direction A. The feed roller 152 feeds the sheet P supplied from the sheet supply tray 106 into a printing area of the print head unit 112. The feed roller 152 is covered with a ceramic layer having a plurality of low protrusions on the outer circumference for preventing slips against the sheet and thereby increase the accuracy of sheet feeding rate.

A press roller 154 for pressing the sheet P against the feed roller 152 is held in parallel with the feed roller 152 by an arm member 156. The arm member 156 is biased by a spring (not shown) to elastically urge the press roller 154 against the feed roller 152.

A discharge roller 158 is disposed to the downstream from the platen 150 with respect to the feeding direction. The discharge roller 158 feeds the sheet passed through the printing area further along the sheet feeding path and thereby discharges the sheet from the inkjet recording device 100.

The platen 150 is provided with two cylindrical engaging portions 160, 162 formed at the corners thereof opposing the discharge roller 158. The discharge roller 158 is inserted through these cylindrical engaging portions 160, 162 to be rotatably engaged with the platen 150. The platen 150 is also provided with a semi-circular engaging portion 164 formed near one of the two corners thereof opposing the feed roller 152. The platen 150 is engaged with the feed roller 152 by inserting the feed roller 152 in the semi-circular engaging portion 164. It should be noted that the inclination of the platen 150 against the feed roller 152 is adjustable since the platen 150 is engaged to the feed roller 152 only at one location as described above.

The feeding mechanism 108 further includes a roller holder 170 for holding a plurality of rollers (not shown in FIG. 3) in the vicinity of the discharge roller 158. The roller holder 170 has notches 172, 174 at both sides thereof and is mounted to the platen 150 such that the cylindrical engaging portions 160, 162 of the platen 150 is placed within these notches 172, 174. In this way, the roller holder 170 and the rollers held thereby are located in place with respect to the discharge roller 158.

The feeding mechanism 108 further includes first and second supporting plates 180, 182 disposed parallel to the sheet feeding direction A such that the platen 150 is placed therebetween. The feeding mechanism 108 also includes an intermediate supporting plate 184 disposed between the second supporting plate 182 and the platen 150 in parallel with the sheet feeding direction A.

The platen 150 and therefore the discharge roller 158 engaged to the platen 150 are supported by the first supporting plate 180 and the intermediate plate 184, while the feed roller 152 is supported by the first and second support plates 180, 182.

The feeding mechanism 108 further includes a driving unit 190 for rotatably driving both the feed roller 152 and the discharge roller 158. The driving unit 190 includes a motor 192 and a gear mechanism 194 for transmitting the driving force from the motor 192 to both the feed roller 152 and the discharge roller 158.

The driving unit 190 is mounted to the second supporting plate. Since the driving unit is mounted to the second supporting plate 182, the second supporting plate 182 is located apart from the platen 150, or outside the printing area of the print head unit 112, such that the driving unit 190 does not interfere with the print head unit 112 that is reciprocally moved across the platen 150 during the printing process.

Figure 4:
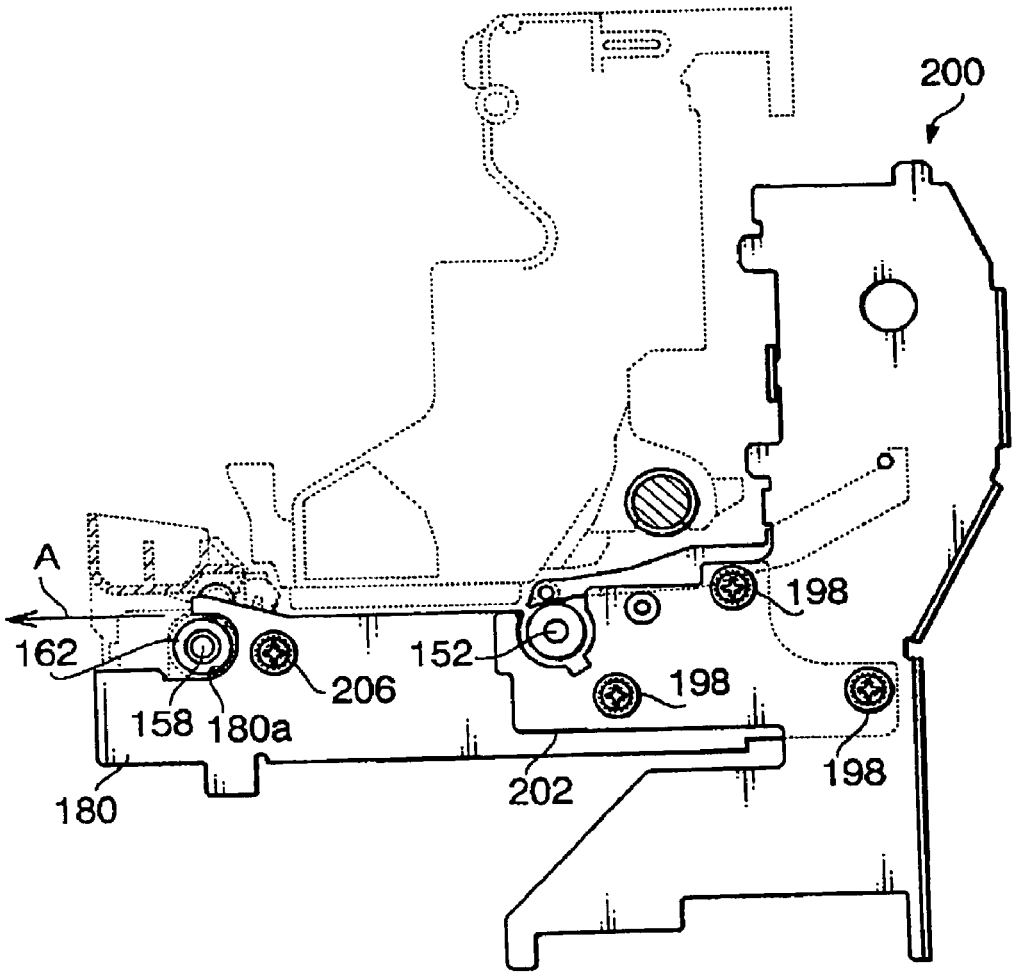
FIG. 4 is a side view of the feeding mechanism showing a first supporting plate thereof.

FIG. 4 is a side view of the feeding mechanism 108 showing the first supporting plate 180. The first supporting plate 180 is fixed to a main frame 200 of the inkjet recording device 100 by means of screws 198. The main frame 200 has an extending portion 202 that extends from the main frame 200 in a direction parallel to the first supporting plate 180. The extending portion 202 is provided with three through holes 204 (see also FIG. 3).

Each of the through holes 204 allows the screw 198 to pass therethrough and screwed into a screw hole formed to the first supporting plate 180. Each through hole 204 is formed sufficiently large so that there is a clearance between the screw 198 and the through hole 204 which makes the position and inclination of the first supporting plate 180 adjustable against the main frame 200 before each screw 198 is tightly fastened.

The first supporting plate 180 is provided with a platen receiving portion 180*a* at the upper portion of the downstream side thereof with respect to the sheet feeding direction A. The platen receiving portion 180*a* loosely receives the cylindrical engaging portion 162 of the platen 150 to allow the platen 150 to move relative to the first supporting plate 180 during an adjustment operation of the position and inclination of the first supporting plate 180 against the main frame 200. A screw 206 is screwed into the platen through the first supporting plate 180 after the adjustment operation to fix the platen 150 against the first supporting plate 180.

It should be noted that the intermediate supporting plate 184 is mounted to the main frame 200 and also fixed with the platen 150 in a similar manner as described above in connection with the first supporting plate 180. Therefore, the position and inclination, or posture, of the intermediate plate 184 against the main frame is also adjustable.

Figure 5:
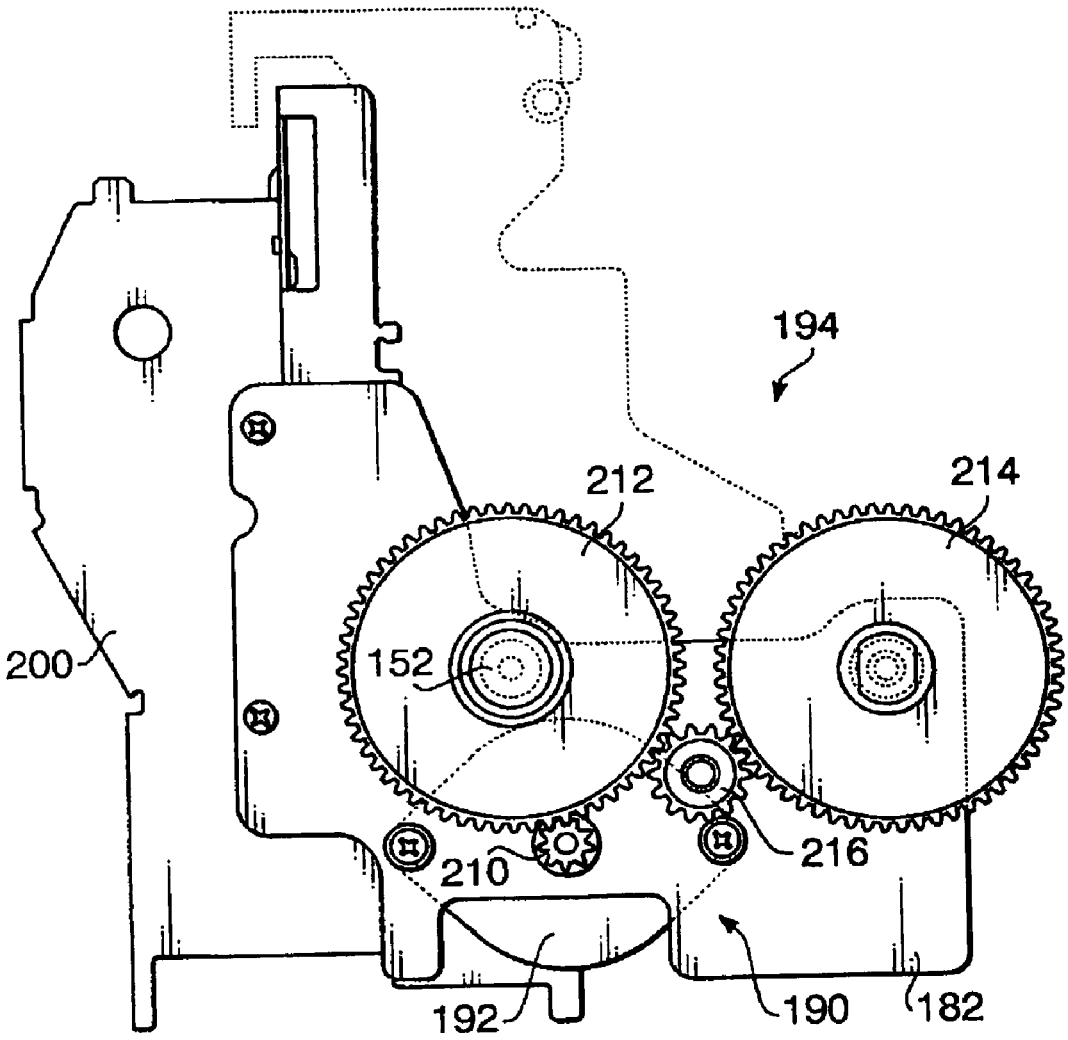
FIG. 5 is a side view of the feeding mechanism showing a second supporting plate thereof.
Figure 6:
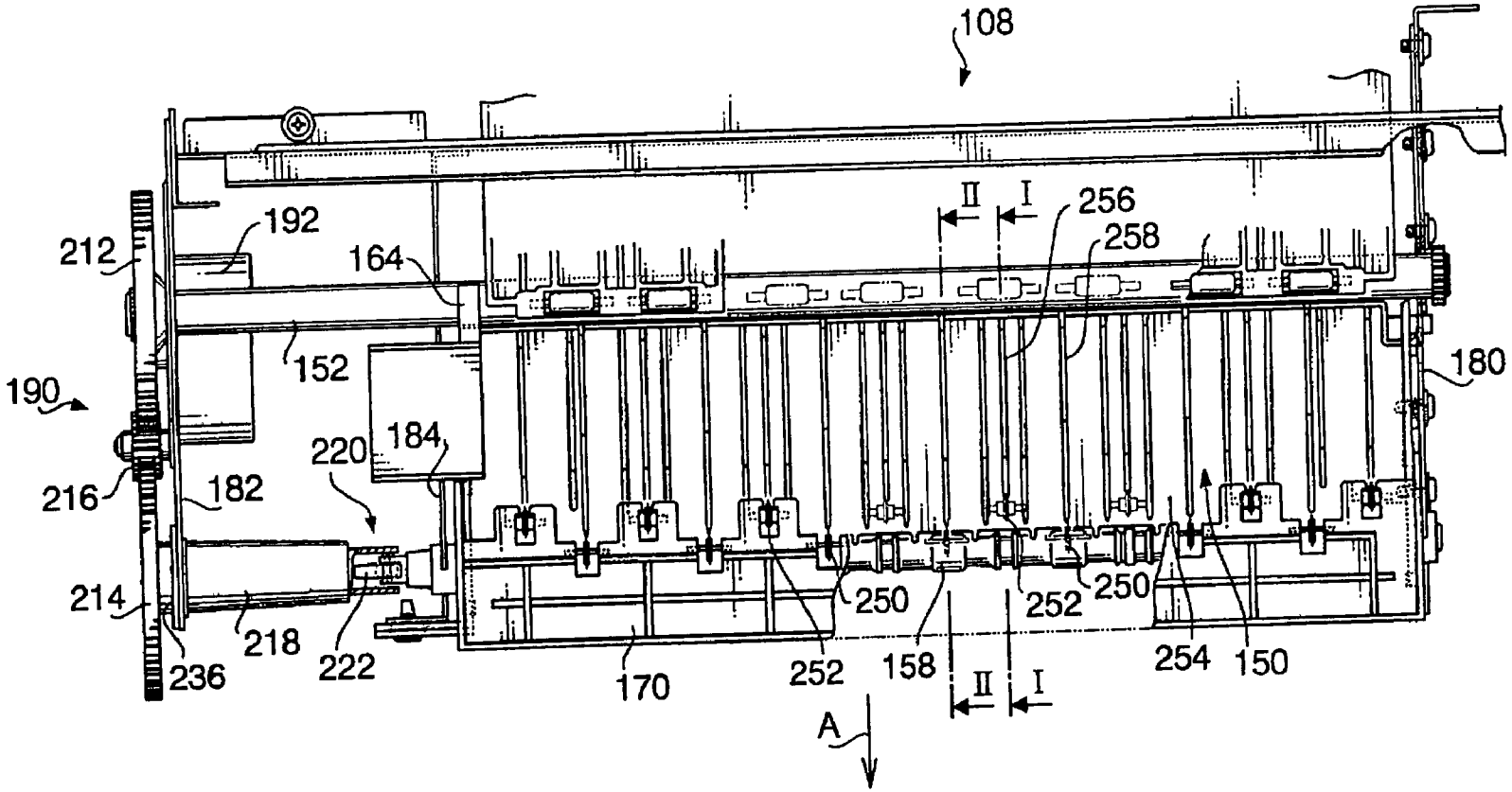
FIG. 6 is a top view of the feeding mechanism.

FIG. 5 is a side view of the feeding mechanism 108 showing the second supporting plate 182, and FIG. 6 is a top view of the feeding mechanism 108. As shown in FIG. 5, the gear mechanism 194 of the driving unit 190 includes a motor pinion gear 210 fixed to a rotation shaft of the motor 192, and a first gear 212 fixed to a shaft of the feed roller 152 and engaged with the motor pinion gear 210 so that the feed roller 152 is rotated by the motor 192. The gear mechanism 194 further includes a second gear 214 and an idle gear 216 engaged with both the first and second gear 212, 214 so that first and second gear 212, 214 rotate simultaneously in the same direction.

As shown in FIG. 6, the second gear 214 has a cylindrical portion 218 integrally formed to one side of the second gear 214 and extending along the rotation axis thereof towards the intermediate supporting plate 184. The cylindrical portion 218 is inserted to a hole, or shaft receiving portion 235, provided in the second supporting plate 182. The shaft receiving portion 235 supports the cylindrical portion 218 at the vicinity of the second gear 214 such that the cylindrical portion 218 can both rotate around the rotation axis of the second gear 214 and incline against the supporting plate 182 in arbitrary directions. The tip end of the cylindrical portion 218 is connected with the discharge roller 158 by a free joint mechanism 220 including a joint member 222.

Figure 7:
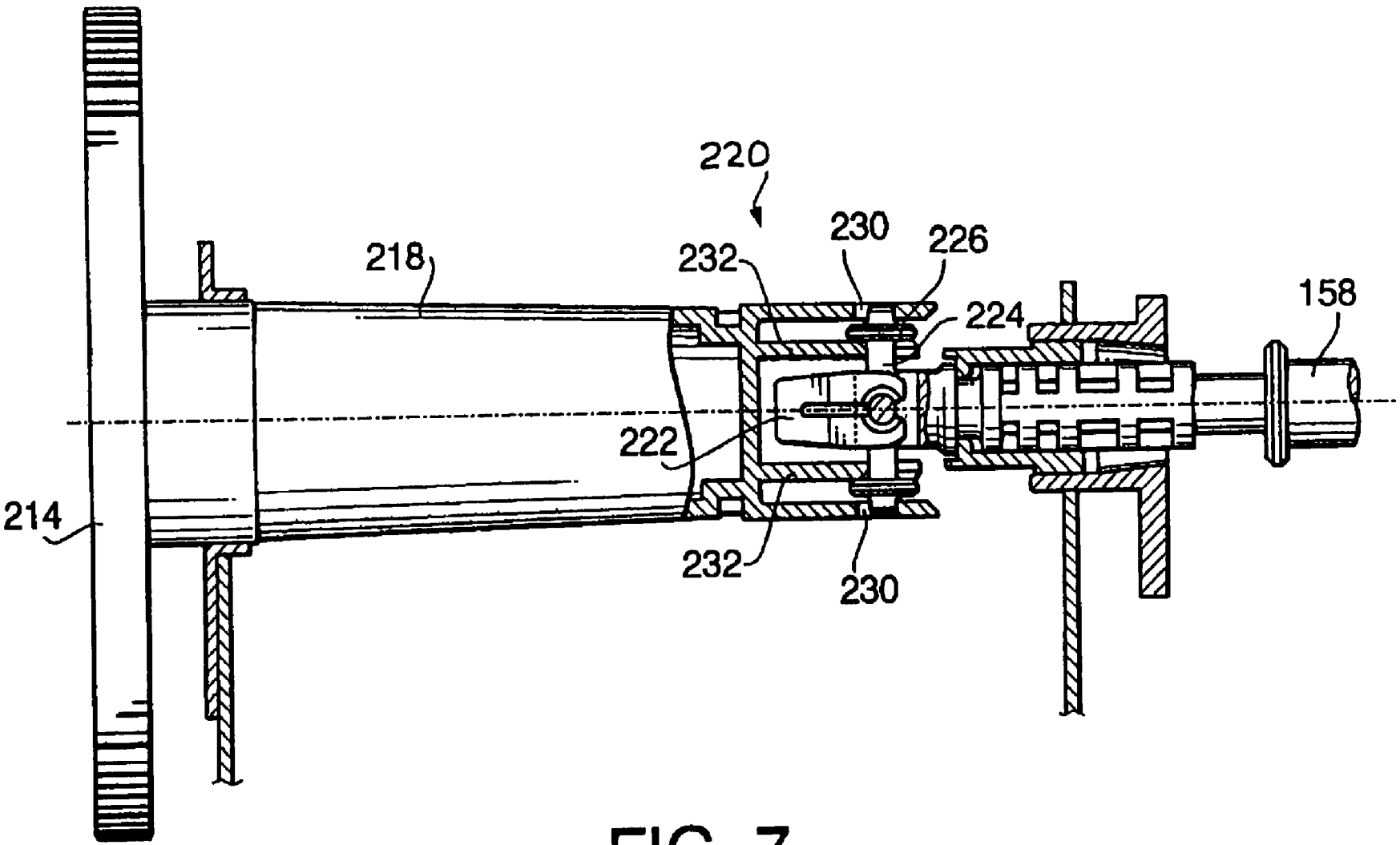
FIG. 7 is an enlarged view of a free joint mechanism utilized in the feeding mechanism.

FIG. 7 is an enlarged view of the free joint mechanism 220 connecting the cylindrical portion 218 of the second gear 214 and the discharge roller 158.

Figure 8:
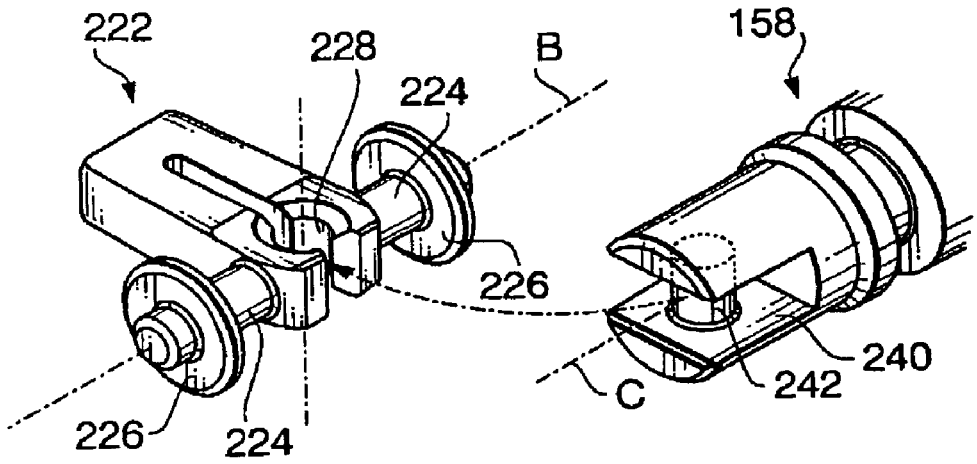
FIG. 8 is a perspective view of a joint member of the joint mechanism and the edge portion of a discharge roller.

FIG. 8 is a perspective view of the joint member 222 of the joint mechanism 220 and the edge portion of the discharge roller 158. The joint member 222 has two shafts 224 formed along a common rotation axis B. A disk like member 226 is provided to each of the shafts 224 near the tip thereof. The joint member 222 further has a shaft receiving portion 228 formed between the two shafts 224 perpendicularly to the rotation axis B of the shafts 224.

The edge portion of the discharge roller 158 has a slit 240 formed along a rotation axis C of the discharge roller 158. Further, a shaft 242 is formed across the slit 240.

The discharge roller 158 is engaged with the joint member 222 by coupling the shaft 242 with the shaft receiving portion 228. Further, the joint member 222 is engaged with the cylindrical portion 218 by fitting the edge of each shaft 224 to respective engaging holes 230 formed at the tip portion of the cylindrical portion 218. The cylindrical portion 218 is further provided with pressing plates 232 that press the disk like members 226 towards the engaging holes 230 and thereby prevent the joint member 222 from coming off from the cylindrical portion 218.

The free joint mechanism 200 described above allows the discharge roller 158 and the cylindrical portion 218 to incline to each other in any direction. Therefore, the cylindrical portion 218, or the second gear 214, and the discharge roller 158 are not required to be precisely located such that their rotation axes coincide, which facilitates the assembly of the feeding mechanism 108.

Further, since the free joint mechanism allows the discharge roller 158, and therefore the platen 150 engaged to the discharge roller 158, to freely incline against the cylindrical portion 218, and since the platen 150 is supported by the first and intermediate supporting plates 180, 184 which are mounted to the main frame with their position and inclination adjustable against the main frame 200, the discharge roller 158 and the platen 150 can be located in parallel with and at a predetermined distance from the print head unit 112, irrespective the inclination of the cylindrical portion 218 of the second gear 214, by adjusting the position of the first and intermediate supporting plates 180, 184.

It should be noted that the discharge roller 158 is formed in a relatively short size although the driving unit 190 is placed apart from the platen 150, or the printing area of the print head unit 112, since the discharge roller 158 is connected with driving unit 190 via the cylindrical portion 218. It should be also noted that since short rollers hardly bend or twist even if the shaft thereof is made of material having relatively low strength, the discharger roller 158 of the present embodiment is provided with a resin shaft instead of a metal shaft to reduce the cost of the recording device 100.

Referring back to FIG. 6, the roller holder 170 supports a plurality of pinch rollers 250 at a constant interval along a sheet width direction of the sheet fed along the sheet feeding path. The pinch rollers 250 are supported such that each of them comes in contact with the discharge roller 158 and follows the rotation thereof.

The roller holder 170 also supports a plurality of guide rollers 252. The guide rollers 252 are arranged along the sheet width direction between the pinch rollers 250 and the print head unit 112 (not shown in FIG. 6) so that the guide rollers 252 are placed apart from the pinch rollers 250, e.g. 5 mm, in the sheet feeding direction A.

In addition, the roller holder 170 supports the guide rollers 252 such that the pinch rollers 250 and guide rollers 252 are alternately arranged in the sheet width direction of sheet fed along the sheet feeding path.

The platen 150 has a planar surface 254 on which a plurality of ribs (256, 258) is formed in parallel with the sheet feeding direction A. The ribs (256, 258) are formed such that the top surfaces thereof are located within a same reference plane. The ribs (256, 258) include a plurality of first ribs 256 each extending towards one of the guide rollers 252 and a plurality of second ribs 258 each extending towards one of the pinch rollers 250.

Figure 9:
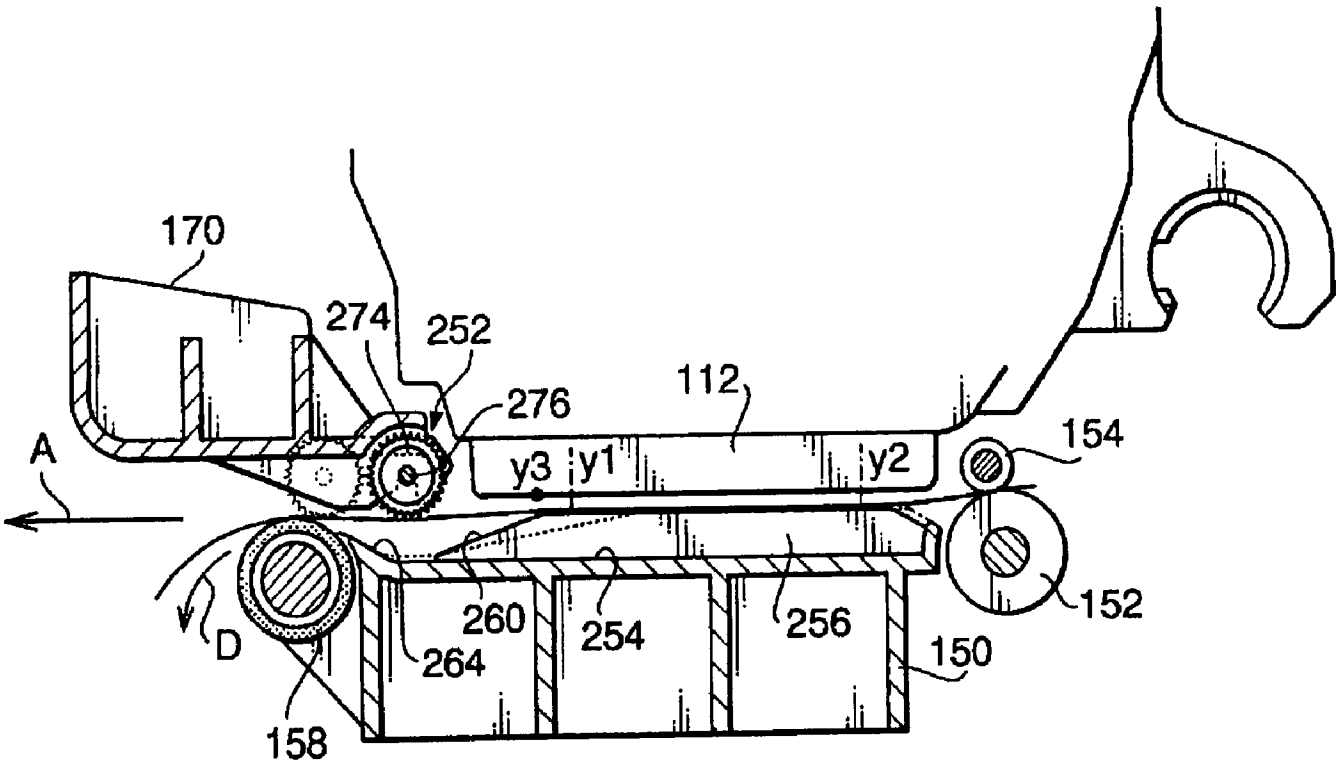
FIG. 9 is a sectional view of the feeding mechanism taken along a line I—I in FIG. 6.
Figure 10:
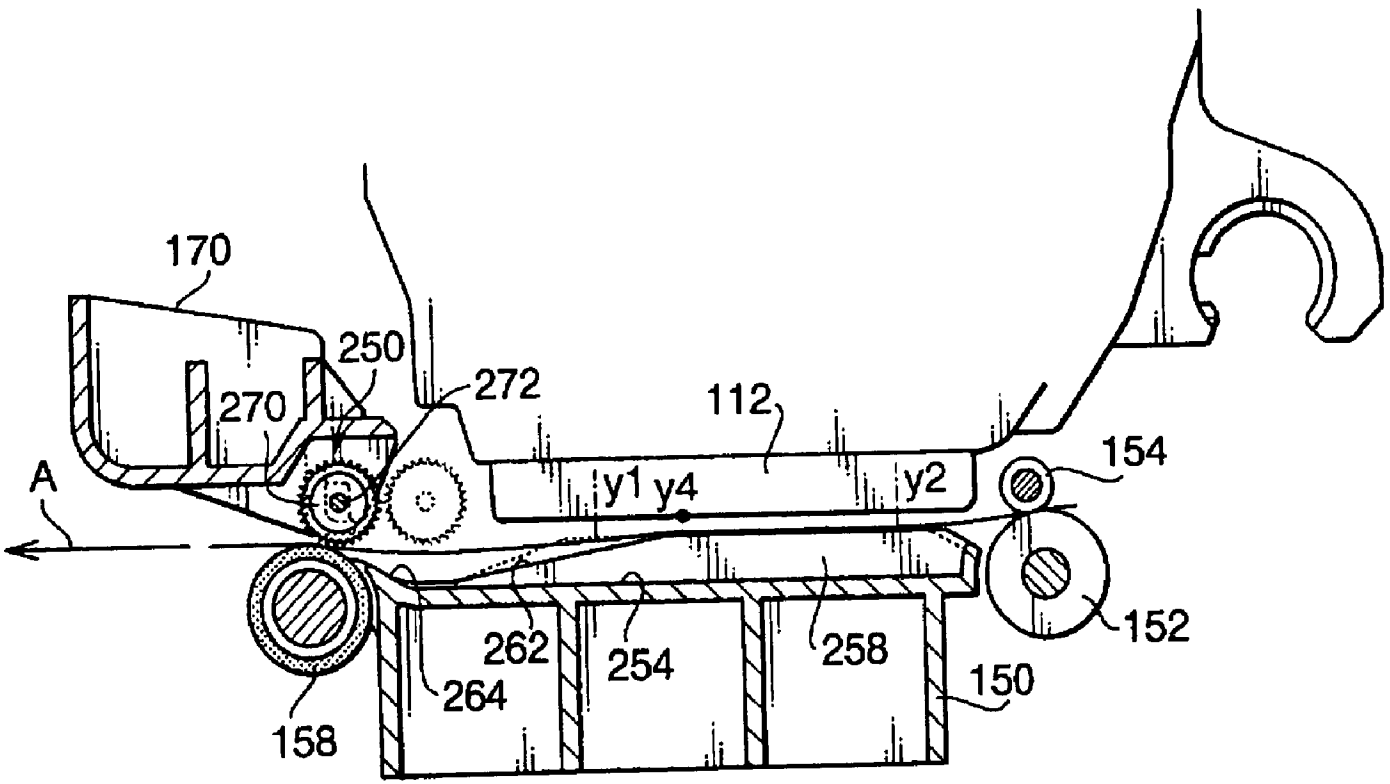
FIG. 10 is a sectional view of the feeding mechanism taken along a line II—II in FIG. 6.

FIG. 9 is a sectional view of the feeding mechanism 108 taken along a line I—I in FIG. 6, or along one of the first ribs 256, and FIG. 10 is a sectional view of the feeding mechanism 108 taken along a line II—II in FIG. 6, or along one of the second ribs 258. Note that the broken lines y1 and y2 in FIGS. 9 and 10 indicates an area where ink are ejected from the print head unit 112 toward the sheet on the platen 150.

The first and second ribs 256, 258 are provided with first and second inclined portion 260 and 262, respectively, which are declining towards the surface 254 at the sides near the guide roller 252 or pinch roller 250. The first inclined portion 260 declines from a position y3 which is a small distance downstream from the area y1–y2 with respect to the sheet feeding direction A while the second inclined surface 262 declines from a position y4 which divides the area y1–y2 approximately at a ratio of 1:3.

An edge portion 264 of the platen 150 located near the discharge roller 158 is inclined upwards such that the edge portion guides the leading end of the sheet between the discharge roller 158 and the pinch roller 250.

The pinch roller 250 includes a disk like member 270 and an elastic shaft 272 made of spring coil, for example. The disk like member 270 is provided with a plurality of protrusions around the outer periphery and therefore has an appearance similar to a spur or a star wheel. The pinch roller 250 is held by the roller holder 170 at the elastic shaft 272 and biased against the discharge roller 158 by the elasticity of the shaft 272.

The pinch roller 250 is located such that the rotation axis thereof is located slightly upstream than the rotation axis of the discharge roller 158 with respect to the sheet feeding direction A so that the sheet caught between the pinch roller and the discharge roller 158 slightly bends towards the platen 150 between the discharge roller 158 and the second ribs 258 of the platen 150. The slight bending of the sheet serves to keep the sheet from floating on the platen 150.

The guide roller 252 is a star wheel including a disk like member 274 having a plurality of protrusions around the outer periphery thereof. The disk like member 274 is provided with a rigid shaft 276 integrally formed thereto. The guide roller 252 is rotatably held at the rigid shaft 276 by the roller holder 170. Accordingly, the guide roller 252 can rotate around the shaft 276 but cannot move in a direction perpendicular to the reference plane defined by the ribs (256, 258) of the platen 150, or the top surface of the platen 150.

The pinch roller 250 and the guide roller 252 are located such that the nip points where the pinch roller 250 and the discharge roller contact the sheet and the contact point where the guide roller contacts the sheet is located within a plane parallel to the reference plane, which is a horizontal plane in some cases, but located slightly lower therefrom, e.g. approximately 0.3 mm below the reference plane.

By the feeding mechanism 108 configured as above, the sheet tends to rotate around a point at which the sheet is sustained by the discharge roller 158 in a direction indicated by the arrow D in FIG. 9 due to the weight of the portion of the sheet already fed beyond the discharge roller 158. If the weight of the sheet already fed beyond the discharge roller 158 is relatively large, the force exerted to the sheet becomes larger than the pressing force of the pinch roller 250. As a result, the sheet lifts up the pinch roller 250 and rotates around the discharge roller 158. The guide roller 252, however, which is held by the roller holder 170 at the rigid shaft 276 and therefore fixed in space, abuts against the sheet and prevents the sheet from floating on the platen 150. Thus, the sheet keeps sliding on the platen 150 and the printing quality does not degrade due to the floating of the sheet.

(Second Embodiment)

Figure 11:
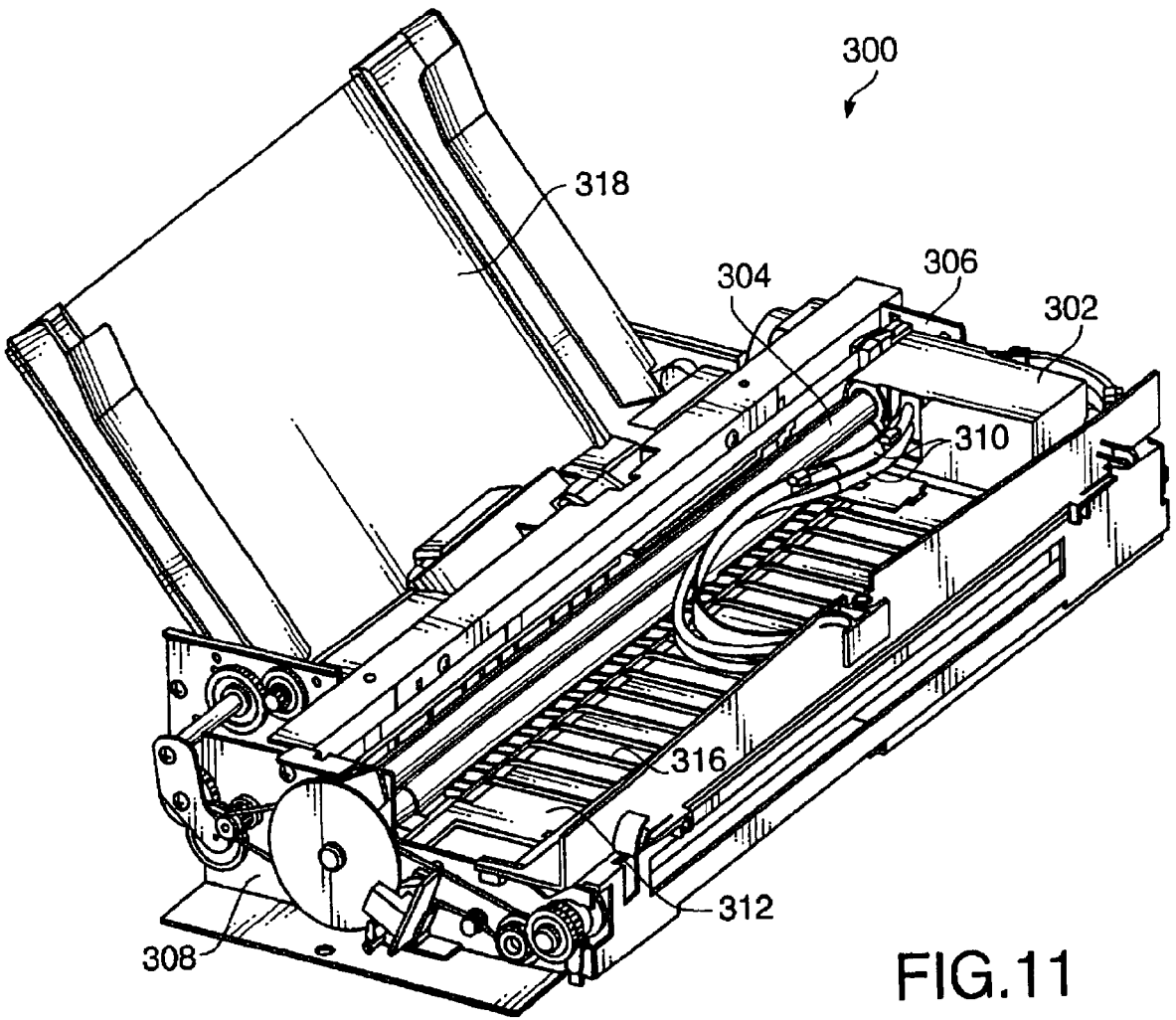
FIG. 11 shows a perspective view of an inkjet printer according to a second embodiment of the invention.

FIG. 11 shows a perspective view of an inkjet printer 300 according to a second embodiment of the invention.

The printer 300 includes a carriage 302 which holds an inkjet print head (not shown in FIG. 1) at the bottom thereof. The carriage 302 is slidably mounted to a guide shaft 304 held by two side frames 306, 308. One or more ink tubes 310 are connected to the carriage 302 to supply ink to the print head from an ink tank (not shown) provided to the bottom of the printer 300.

The carriage 302 is moved along the guide shaft 304 by a known driving mechanism (not shown) provided to rear of the printer 300. A platen 312 is located below the space in which the carriage 302 moves. The platen 312 has a plurality of ribs 316 on the upper side thereof. The ribs 314 support, at their top surfaces, a sheet supplied from a sheet supply tray 318 along a reference plane which is parallel to and a predetermine distance apart from the undersurface of the print head.

Figure 12A:
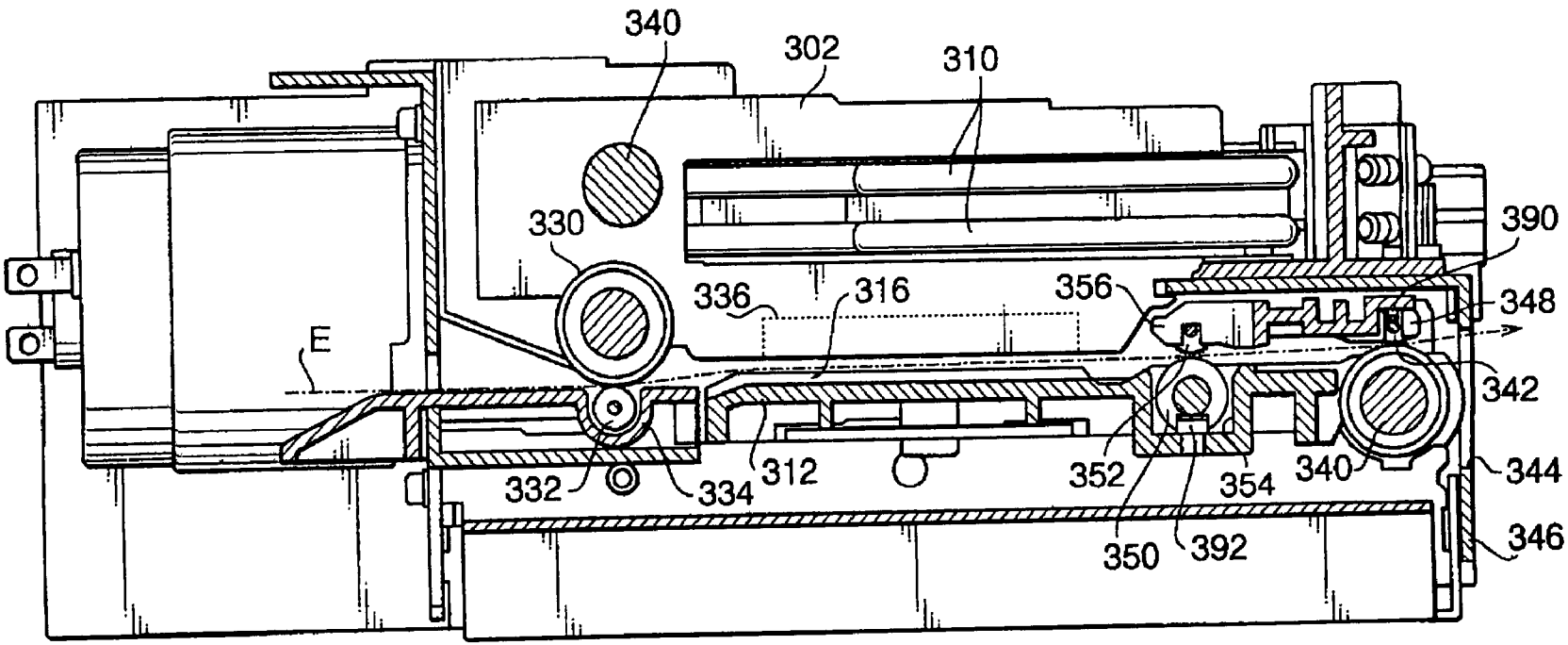
FIG. 12A is a schematic cross sectional view of the printer shown in FIG. 11.

FIG. 12A is a schematic cross sectional view of the printer 300 shown in FIG. 11. In FIG. 12A, the dotted line E indicates a sheet feeding path along which the sheet supplied from the sheet supply tray (not shown in FIG. 12A) is fed.

A feed roller 330 and a pressing roller 332 are located to the upstream side of the sheet feeding path E with respect to a printing area of the print head. The feed roller 330 and the pressing roller 332 are disposed such that the feed roller 330 comes in contact with the sheet at the side to be printed and the pressing roller 332 with the other side. The feed roller is rotatably supported by the side frames 306, 308 such that the rotation axis thereof is fixed relative to the reference plane defined by the platen 312, in particular, in a direction perpendicular to the reference plane.

The pressing roller 332 is supported by a roller holder 334 which elastically biases the pressing roller 332 towards the feed roller 330. When the leading end of the sheet supplied from the sheet supply tray comes to the feed roller 330, the pressing roller 332 is urged away from the feed roller 330 by the sheet at a distance corresponding to the sheet thickness and allows the sheet to be caught between the feed roller 330 and pressing roller 332.

The sheet is then pressed against the feed roller 330 by the pressing roller 332 so that it does not slip against the feed roller 330, and fed toward the printing area by the rotation of the feed roller 330.

Note that both feed roller 330 and pressing roller 332 are covered with elastic layers such as rubber layers to increase the friction against the sheet and prevent slips against the sheet.

A discharge roller 340 and a plurality of first pinch rollers 342 (only one is shown in FIG. 2) are located to the downstream side of the sheet feeding path E with respect to the printing area. The discharge roller 340 and the first pinch rollers 342 catch the sheet coming from the printing area therebetween and feed the sheet towards an opening 344 formed at a front plate 346 until the sheet drops therethrough.

The discharge roller 340 and the first pinch rollers 342 are disposed such that the discharge roller 340 comes in contact with the sheet at the clean side (not printed side) thereof while the first pinch rollers 342 with the other side. The discharge roller is fixed to the side frames 306, 308 such that the rotation axis thereof is fixed relative to the reference plane defined by the platen 312.

The discharge roller 340 is covered with an elastic layer such as a rubber layer, like the feed roller 330, to increase the friction against the sheet.

Each of the first pinch rollers 342 are star wheels having essentially same configurations as that of the first pinch roller 252 shown in FIG. 9. That is, each first pinch roller 342 has a plurality of protrusions around the outer periphery and a rigid rotation shaft integrally formed thereto.

Each first pinch roller 342 is supported by a roller holder 348 at the rotation shaft. The roller holder 342 includes a plurality of plate springs 390 (only one shown in FIG. 12A) that press the rotation shafts of the first pinch rollers 342 to bias the pinch rollers 342 towards the discharge roller 340.

Accordingly, when the leading end of the sheet fed along the sheet feeding path E comes to the discharge roller, the first pinch rollers 342 are moved away from the discharger roller due to the thickness of the sheet and thereby allows the sheet to be caught between the discharge roller 304 and the first pinch rollers 342.

An intermediate roller 350 and a plurality of second pinch rollers 352 are provided between the discharge roller 340 and the printing area such that the intermediate roller 350 sustains the clean side of the sheet while the second pinch rollers come in contact with the sheet at the printed side. The intermediate roller 350 is held by a groove 354 formed to the platen 312.

Figure 12B:
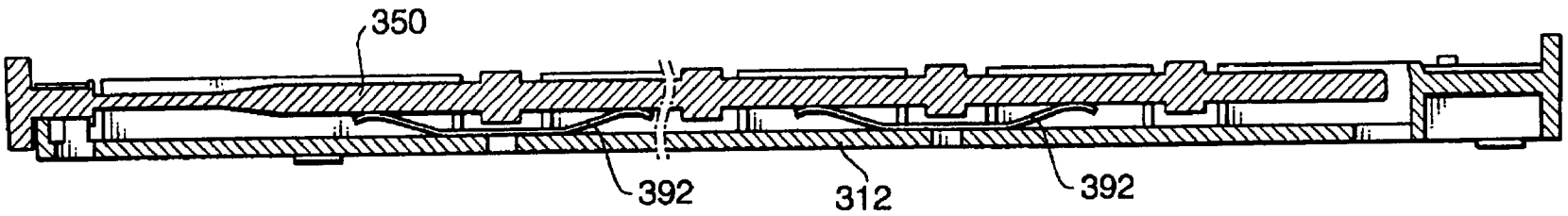
FIG. 12B is a cross sectional view of a groove formed in a platen of the printer of FIG. 12A taken along a rotation axis of the intermediate roller provided in the groove.

FIG. 12B is a cross sectional view of the groove 354 of the platen 312 and the intermediate roller 350 taken along the rotation axis of the intermediate roller 350. A plurality of elastic members 392 such as leaf springs are provided in the groove 354 to press the intermediate roller 350. Thus, the intermediate roller 350 is elastically biased towards the pinch roller.

Each of the second pinch rollers 352 is formed in a substantially same configuration as that of the first pinch roller 342. The second pinch rollers 352 are rotatably held by a roller holder 356 such that the rotation thereof is fixed with respect to the reference plane defined by the platen 312 and do not move, in particular, in the direction perpendicular to the reference plane.

The discharge roller 340 and the second pinch rollers 352 are located such that the points where the discharge roller 340 and the second pinch rollers 352 come in contact with the sheet is within a plane parallel to the reference plane defined by the platen 312. Therefore, the sheet supported simultaneously at the discharge roller 340 and at the second pinch rollers 352 (the intermediate roller 354) declines towards the platen 312 at an angle determined by the thickness of the sheet, and the sheet is kept from floating on the platen 312.

Figure 13:
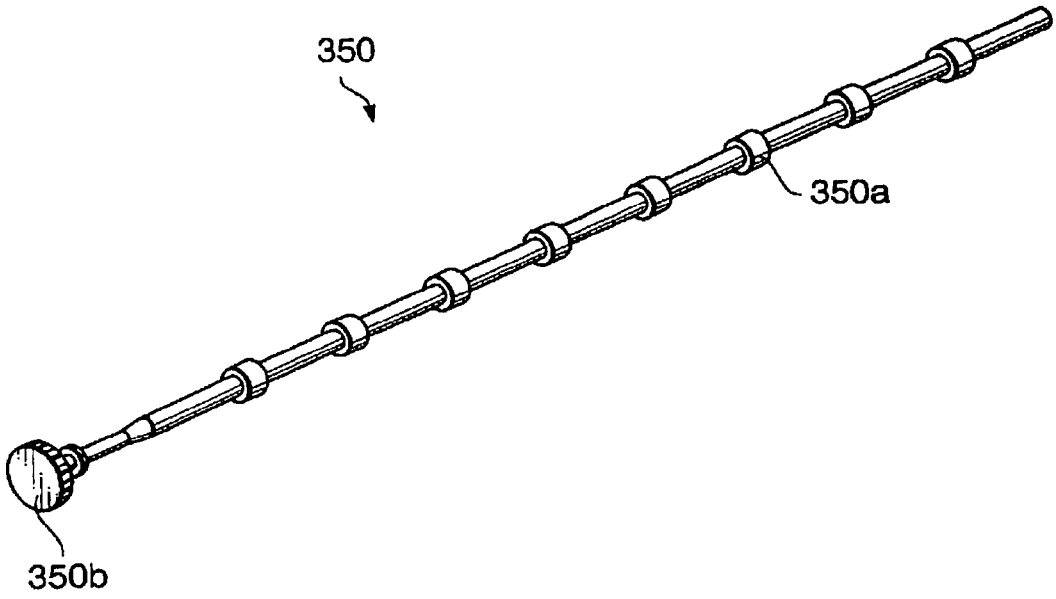
FIG. 13 is a perspective view of a intermediate roller shown in FIG. 12A.

FIG. 13 is a perspective view of the intermediate roller 350 shown in FIG. 12A. The intermediate roller 350 is one piece made of hard resin, or resin having low elasticity, such as POM (Polyoxymethylene) and ABS (Acrylonitrile Butadiene Styrene). The intermediate roller 350 has a plurality of larger diameter portions 350*a* spaced apart from each other at constant intervals. The intermediate roller 350 comes in contact with the sheet fed along the sheet feeding path E only at these larger diameter portion 350*a*. Therefore, the contact area between the intermediate plate 350 and the sheet is quite small.

It should be noted that the intermediate roller 350 is not covered with any elastic layer and it comes in direct contact with the sheet at the larger diameter portions 350*a*. Since the intermediate roller is made of hard resin of which surface has low coefficient of friction, and since the contact area is quite small, the friction between the intermediate roller 350 and the sheet is much lower than that between the sheet and the feed roller 330 or discharge roller 340.

A gear 350*b* is integrally formed at one side of the intermediate roller 350. The gear 350*b* serves as a part of a power transmission mechanism 360 which will be described hereinafter with reference to FIGS. 14 and 15.

Figure 14:
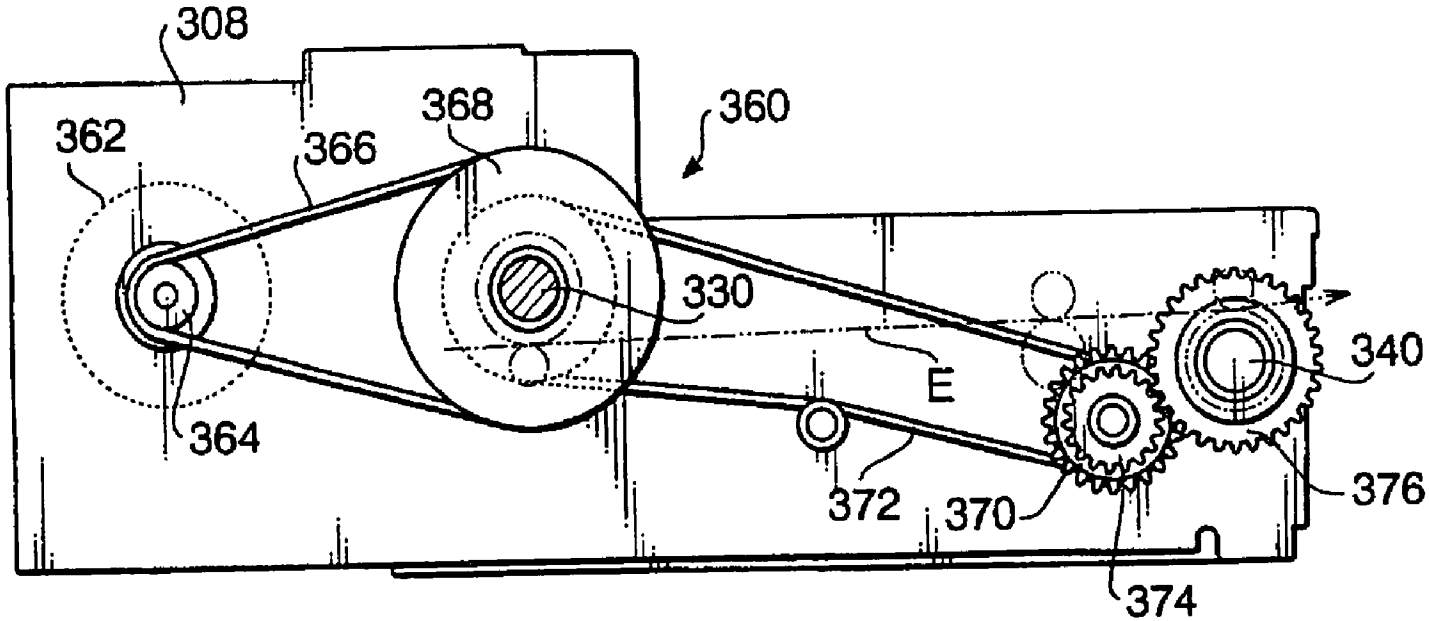
FIG. 14 is a plan view of a power transmission mechanism provided to the printer shown in FIG. 11.
Figure 15:
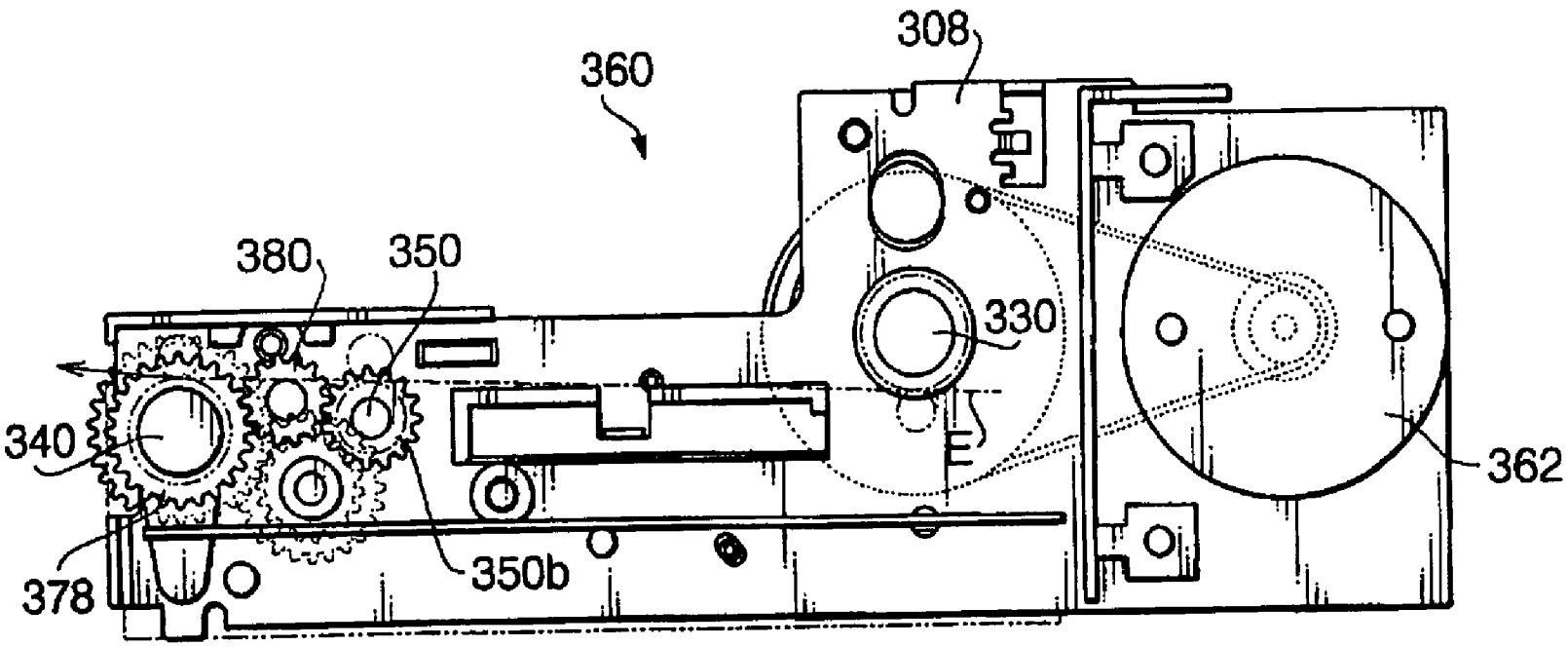
FIG. 15 is a plan view showing the back side of the power transmission mechanism of in FIG. 14.

FIG. 14 is a plan view of the power transmission mechanism 360 provided to the printer 300 shown in FIG. 11 for simultaneously rotating the feed roller 330, the discharge roller 340 and the intermediate roller 350, and FIG. 15 is a plan view showing the back side of the power transmission mechanism 360 of in FIG. 14.

The power transmission mechanism 360 includes a motor 362 mounted to the side frame 308 (see FIG. 15), and a first gear 364 fixed to the rotating shaft of the motor 362 as shown in FIG. 14. The driving force of the motor 362 is transmitted from the first gear 364 to the feed roller 330 via a first synchronous belt 366 and a reduction pulley 368 which is fixed to the feed roller 330. The driving force of the motor 362 is further transmitted to the discharge roller 340 from the reduction pulley 368 to a second gear 370 by a second synchronous belt 372, and further by a third gear 374, that is formed integrally with the second gear 370, to a fourth gear 376 fixed to the discharge roller 340.

Referring now to FIG. 15, the discharge roller 340 is connected with the intermediate roller 350 by a fifth gear 378 fixed to the discharge roller 340 and an idle roller 380 engaged with both the fifth gear 378 and the gear 350*b* formed integrally at end of the intermediate roller 350. Thus, the driving force of the motor 362 is also transmitted from the discharge roller 340 to the intermediate roller 350.

Note that the gear ratio of the gears constituting the power transmission mechanism 360 is adjusted such that peripheral velocity of the discharge roller 340 is same as that of the feed roller 330 and such that the peripheral velocity of the intermediate roller 350 is slightly higher than those of the feed roller 330 and the discharge roller 340.

Now, the sheet feeding operation of the inkjet printer 300 shown in FIG. 11 will be described.

First, one sheet of the sheets stacked in the sheet supply tray is picked up and supplied towards the feed roller 330. The sheet reached to the feed roller 330 is caught between the feed roller 330 and the pressing roller 332. Then, the power transmission mechanism 360 rotates the feed roller 332 to feed the sheet towards the printing area defined between the print head 336 and the platen 312.

When a portion of the sheet near the leading end has reached to the printing area, the feeding of the sheet is stopped. Then, the carriage 302 is moved along the guide shaft 304 so that the print head 336 scans the sheet in the width direction while ejecting ink towards the sheet. After the print head 336 has scanned the sheet once, the feed roller 330 feeds the sheet for a small amount. Then, the print head 336 scans the sheet again.

The step of scanning the print head 336 over the sheet and the step of feeding the sheet for a small amount are alternately repeated so that the sheet advances along the sheet feeding path E towards the intermediate roller 350.

When the leading end of the sheet reaches the intermediate roller 350, the sheet is pulled by the intermediate roller 350, which is rotated at a higher peripheral velocity than that of the feed roller 330, and the leading end of the sheet get smoothly caught between the Intermediate roller 350 and the second pinch rollers 352.

After the sheet is nipped between the intermediate roller 350 and the second pinch rollers 352, a slip occurs between the intermediate roller 350 and the sheet since the friction of the intermediate roller 350 against the sheet is much smaller than that between the feed roller 330 and the sheet, as mentioned before. Thus, the intermediate roller 350 pulls the sheet and thereby applies tension to the sheet, which prevents the sheet from bending in the printing area, however, the intermediate roller 350 does not feed the sheet faster than the peripheral velocity of the feed roller 330. As a result, variation of the feed velocity, which may cause deterioration of printing quality, does not occur at the moment or after the sheet get caught between the intermediate roller 350 and the second pinch roller 352.

As the printing process proceeds, the sheet further advances along the sheet feeding path E and finally get caught between the discharge roller 340 and the first pinch rollers 342. As already described, the discharge roller 340 is rotated with same peripheral velocity as that of the feed roller 330. Therefore, the feed velocity does not change at the moment or after the sheet is caught between the discharge roller 340 and the first pinch rollers 342.

As the sheet is further fed along the sheet feeding path E, the trailing end of the sheet passes the feed roller 330 and the sheet becomes to be supported only at the intermediate roller 350 and the discharge roller 340. In this condition, the intermediate roller 350 feeds the sheet towards the discharge roller 340. However, a slip occurs again between the intermediate roller 350 and the sheet since also the discharge roller covered with the elastic layer that has larger friction against the sheet. Thus, the feed velocity of the sheet does not change even after the trailing end has passed the feeding roller and become free therefrom.

At last, the sheet is fed along the sheet feeding path E by the discharge roller 340 towards the opening 344 formed at the front plate 346 of the printer 300 and dropped therethrough to the out side of the printer 300.

As described above, the inkjet printer 300 according to the second embodiment of the invention feeds the sheet therethrough with a constant feed velocity and the deterioration of printing quality due to variation of sheet feeding velocity does not occur.

The present disclosure relates to the subject matters contained in Japanese Patent Applications No. 2001-259487, filed on Aug. 29, 2001, No. 2001-259488, filed on Aug. 29, 2001, and No. 2002-097491, filed on Mar. 29, 2001, which are expressly incorporated herein by reference in its entirety.

What is claimed is:

1. A printer, comprising:

a print head including nozzles that eject ink on a recording medium sheet;

first and second rollers provided on a sheet feeding path for feeding said sheet therealong;

a platen provided between said first and second rollers for guiding said sheet on said sheet feeding path;

a guide roller disposed between said nozzles and said second roller on said feeding path in the vicinity of said second roller, a rotation axis of said guide roller being fixed with respect to said feeding path; and a pinch roller elastically biased towards said second roller to press said sheet against said second roller, wherein said guide roller is disposed such that said guide roller contacts said sheet below a top surface of said platen, and said pinch roller is disposed such that a nip point where said pinch roller and said second roller contact said sheet is located below said top surface of said platen.

2. The printer according to claim 1, wherein said nip point and a contact point where said guide roller contacts said sheet are located on a plane parallel to said top surface of said platen.

3. The printer according to claim 1, wherein said first roller and said guide roller contact said sheet at the side opposite to the side sustained by said platen.

4. The printer according to claim 1, further comprising:

a plurality of pinch rollers elastically biased towards said second roller to press said sheet against said second roller; and a plurality of said guide rollers, wherein said pinch rollers and said guide rollers are alternately disposed in a sheet width direction.

5. The printer according to claim 4, wherein said guide rollers are star wheels.

6. The printer according to claim 4, wherein said pinch rollers are star wheels.

7. The printer according to claim 4, wherein nip points where said pinch rollers and said second roller contact said sheet and contact points where said guide rollers contact said sheet are located below a top surface of said platen.

8. The printer according to claim 7, wherein said nip points and said contact points are located on a plane parallel to the top surface of said platen.

9. The printer according to claim 7, wherein said second roller is rotated with a peripheral velocity the same as that of said first roller.

10. The printer according to claim 1, further comprising, a driving unit located outside a printing area of said print head at a distance sufficient for preventing interference between said driving unit and said print head, wherein said second roller includes a shaft extending along a rotation axis of the second roller, said driving unit including an extension shaft extending toward said second roller and being connected to the shaft of said second roller, said driving unit transmitting driving force to said second roller via said extension shaft to rotate it.

11. The printer according to claim 10, wherein said extension shaft is connected with the shaft of said second roller by a free joint mechanism.

12. The printer according to claim 10, wherein said second roller is held by a holding mechanism that is able to adjust the posture of said second roller relative to said print head.

13. The printer according to claim 10, which further comprises a main frame and a supporting member for supporting said platen, wherein said platen rotatably holds said second roller, and wherein said supporting member is mounted on said main frame in such a fashion that the inclination of said supporting member with respect to said main frame is adjustable.

14. The printer according to claim 10, wherein said second roller is rotatably fixed to one end of said platen such that said platen is kept parallel to said second roller.

15. The printer according to claim 10, wherein said driving unit includes a motor and a plurality of gears for transmitting the driving force from said motor, said extension shaft being a protrusion formed to one of said gears along the rotation axis thereof.

16. The printer according to claim 10, wherein said second roller has a shaft made of resin.

17. The printer according to claim 1, wherein said guide roller is separated from said second roller in a sheet feed direction.

18. The printer according to claim 1, further comprising a rib formed on said platen in parallel with a sheet feeding direction, wherein said rib extends toward said guide roller.

19. The printer according to claim 18, further comprising, a driving unit located outside a printing area of said print head at a distance sufficient for preventing interference between said driving unit and said print head, wherein said second roller includes a shaft extending along a rotation axis of the second, roller, said driving unit including an extension shaft extending toward said second roller and being connected to the shaft of said second roller, said driving unit transmitting driving force to said second roller via said extension shaft to rotate it.

20. The printer according to claim 1, wherein said second roller and said guide roller contact first and second sides, respectively, of said recording medium sheet.

21. The printer according to claim 20, further comprising, a driving unit located outside a printing area of said print head at a distance sufficient for preventing interference between said driving unit and said print head, wherein said second roller includes a shaft extending along a rotation axis of the second roller, said driving unit including an extension shaft extending toward said second roller and being connected to the shaft of said second roller, said driving unit transmitting driving force to said second roller via said extension shaft to rotate it.

22. The printer according to claim 1, wherein said guide roller is driven to rotate by said sheet, as the sheet is fed, due to friction therebetween.

23. The printer according to claim 22, further comprising, a driving unit located outside a printing area of said print head at a distance sufficient for preventing interference between said driving unit and said print head, wherein said second roller includes a shaft extending along a rotation axis of the second roller, said driving unit including an extension shaft extending toward said second roller and being connected to the shaft of said second roller, said driving unit transmitting driving force to said second roller via said extension shaft to rotate it.

* * * * *